US007311220B2

(12) United States Patent
Kellerer

(10) Patent No.: US 7,311,220 B2
(45) Date of Patent: Dec. 25, 2007

(54) COLLAPSIBLE CONTAINER COMPRISING A CONTAINER BASE AND FOUR COLLAPSIBLE LATERAL WALLS

(75) Inventor: Richard Kellerer, Munich (DE)

(73) Assignee: Schoeller Wavin Systems Services GmbH (DE)

( * ) Notice: Subject to any disclaimer, the term of this patent is extended or adjusted under 35 U.S.C. 154(b) by 240 days.

(21) Appl. No.: 10/500,678

(22) PCT Filed: Jan. 2, 2003

(86) PCT No.: PCT/EP03/00006

§ 371 (c)(1),
(2), (4) Date: Dec. 22, 2004

(87) PCT Pub. No.: WO03/055753

PCT Pub. Date: Jul. 10, 2003

(65) Prior Publication Data

US 2005/0098556 A1 May 12, 2005

(30) Foreign Application Priority Data

Jan. 3, 2002 (DE) ..... 102 00 070

(51) Int. Cl.
*B65D 25/00* (2006.01)
*B65D 6/00* (2006.01)
*E05C 1/12* (2006.01)

(52) U.S. Cl. ..... 220/700; 292/169; 220/4.16

(58) Field of Classification Search ..... 292/169.17, 292/192, 314.17, 95, 98, 100, 101, 106, 240, 292/194, 197, 200; 220/324, 4.28, 4.16, 220/4.08, 1.5; 403/146, 330
See application file for complete search history.

(56) References Cited

U.S. PATENT DOCUMENTS

| | | | | |
|---|---|---|---|---|
| 1,575,647 | A * | 3/1926 | Schrader | 292/332 |
| 2,665,155 | A * | 1/1954 | Figley | 292/194 |
| 3,401,814 | A * | 9/1968 | Patrick | 220/4.33 |
| 4,020,967 | A * | 5/1977 | Hammond et al. | 220/6 |
| 5,056,667 | A * | 10/1991 | Coogan | 206/600 |
| 6,415,938 | B1 * | 7/2002 | Karpisek | 220/1.5 |

* cited by examiner

*Primary Examiner*—Anthony D. Stashick
*Assistant Examiner*—Shawn M. Braden
(74) *Attorney, Agent, or Firm*—VanOphem & VanOphem, PC

(57) ABSTRACT

The invention relates to a collapsible container having a container base and four collapsible walls. The catch mechanism for the lockable lateral walls in their upright assembled condition is a resilient pivotable lock member contained within a recess of the lateral wall having a projecting tongue latching member that cooperates with opposing ramps of a locating lug located on the adjacent wall member to lock the adjacent walls to each other.

21 Claims, 4 Drawing Sheets

COLLAPSIBLE CONTAINER COMPRISING A CONTAINER BASE AND FOUR COLLAPSIBLE LATERAL WALLS

CROSS-REFERENCE TO RELATED APPLICATIONS

This application claims the benefit of International Patent Application No. PCT/EP/03/00006 filed on Jan. 2, 2003, which claims the benefit of German Patent Application No. 102 00 070.0 filed on Jan. 3, 2002.

FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The invention relates to a collapsible container according to the preamble of claim 1.

2. Description of the Prior Art

Collapsible containers of this type are widely used in trade because the containers can be reduced in size simply by folding the walls inwards on top of each other towards the base, while providing ample transport and receiving volume when the lateral walls are folded outwards into an upright position. Containers of this kind have a container base that is usually rectangular, to which are hinged the edges of the collapsible lateral walls, by articulated hinges or by integrally molded-on film hinges. When in the folded out or upright position, the lateral walls are interconnected by a snap-in catch, with appropriate snap locks on one pair of opposing lateral walls engaging behind corresponding latches on the other pair of opposing lateral walls. However, releasing the catch on this type of collapsible container in order to convert the collapsible container from its service condition with upright lateral walls into the collapsed position with folded-down lateral walls is often problematic. Depending on the design of the collapsible container, folding the lateral walls upwards towards the snap-in catch in order to form the collapsible container is often awkward also, for those who are unfamiliar with the catch mechanism, it is frequently difficult to accomplish. Moreover, some containers give the impression of being very unstable when assembled, because the snap-in catch is not sturdy. Often, the lateral walls of the assembled container are not held firmly by the snap-in catches and therefore remain wobbly. When handled, these assembled collapsible containers are rickety and often collapse by accident, which is of course extremely annoying.

SUMMARY OF THE INVENTION

The object of the invention is to provide a collapsible container with lateral walls that can be folded upwards into an upright position, which ensures that the container's upright-folded lateral walls are interconnected by very sturdy snap-in catches and which permits simple releasing and locking of the lateral walls in their collapsed and upright-folded positions, especially for large collapsible containers.

According to the invention, the catch members are configured as pivoting locks mounted in opposing side walls. Each pivoting lock is expediently shaped as a circular-sector component and mounted on two opposite laterals walls. A pivoting lock of this kind immediately conveys to a non-specialist how to actuate the locking and release mechanism, namely by appropriate rotary movement of the pivoting lock. It is also easy to convey this information visually to the user of the collapsible container, for example by means of an arrow painted on the pivoting lock or otherwise applied thereto.

The pivoting locks are preferably mounted on the short lateral walls of the container. When the lateral walls are to be collapsed, these short walls are folded towards the base first, and then the long lateral walls are folded down onto the collapsed short walls. The pivoting locks are conveniently mounted at the two upper edges of the short lateral walls, in particular at the two upper corner areas of the lateral walls.

Rotation of the pivoting lock is accomplished via a pivot pin which simultaneously serves as a connecting member for mounting the pivoting lock on the lateral wall.

To this end, the pivoting lock is configured with a pivot pin provided with latches. The pivot pin of the pivoting lock is engaged in a corresponding bushing in the lateral wall. In the engaged position, the pivoting lock can then be rotated about the axis of the pivot pin to unlatch the lateral wall for folding the wall towards the base. Of course, it is also possible to configure the pivot pin on the longer lateral wall with the bushing also mounted on the longest lateral walls.

The locking mechanism works via projecting locking tongues configured on the pivoting lock and engaging behind corresponding locating lugs located on the longest lateral walls, on the adjacent side of the corner. The pivoting lock is opened against a pretensioning spring, which, as the pivoting lock is opened, is pressed against a stop and thus pretensioned. When the pivoting lock is then released, the locking tongue extends again automatically and the pivoting lock moves into its rest position. Releasing the lateral walls for folding purposes thus only necessitates manually rotating the pivoting lock, which is easily accomplished by gripping a grip member on the pivoting lock and swinging the grip member upwards; simultaneously with the rotary movement, the lateral walls can be collapsed inwards. According to another configuration or embodiment of the locking mechanism, the opening movement can also ensue by swinging the grip member sideways or downwards; here too, the lateral walls can be collapsed inwards substantially simultaneously. When the pivoting lock is thereafter released, the spring pretensioning force causes it to return to its starting or rest position, in which the locking tongues are extended. If the collapsible container is to be converted from its collapsed condition to its service condition with upright walls, it is merely necessary to fold the two long lateral walls upwards, followed by the two short lateral walls. The locking tongues are pressed in automatically when the ramp surfaces on the front of the locking tongues ascend the ramp surfaces located on the locating lugs, during this motion the springs become pretensioned. As soon as the locking tongues have moved behind the locating lugs, locking of all of the lateral walls ensues automatically. This is because the pivoting lock is rotated by the spring tensioning force that has built up, and the locking tongues are extended to engage behind the locating lugs. Suitable detent members are expediently attached to the lateral walls on the other side of the corner, resulting in a sturdy snap interlocking connection between the collapsible lateral walls, which accordingly do not wobble. The invention is characterized by very easy handling as far as releasing and locking the lateral walls in upright position, and it also guarantees very secure snap connections between the walls, which prevent wobbling of the lateral walls. Actuation, that is, opening and closing, of the collapsible container also ensues automatically by appropriate actuation on the part of the user of the collapsible container, by gripping the pivoting locks and rotating them to release the locking tongues and in turn the lateral walls can then be collapsed inwards onto the base. To assemble the container in its service form, it is only necessary to fold the lateral walls upwards. Locking of the lateral walls to form sturdy, snap-in connections ensues automatically, without the need for manual operation of the pivoting locks, ascent ramps or the like.

BRIEF DESCRIPTION OF THE DRAWINGS

In the following, a preferred embodiment of the invention is described with reference to the drawings, which are purely schematic and intended as examples.

DETAILED DESCRIPTION OF THE PREFERRED EMBODIMENT

Figure 1:
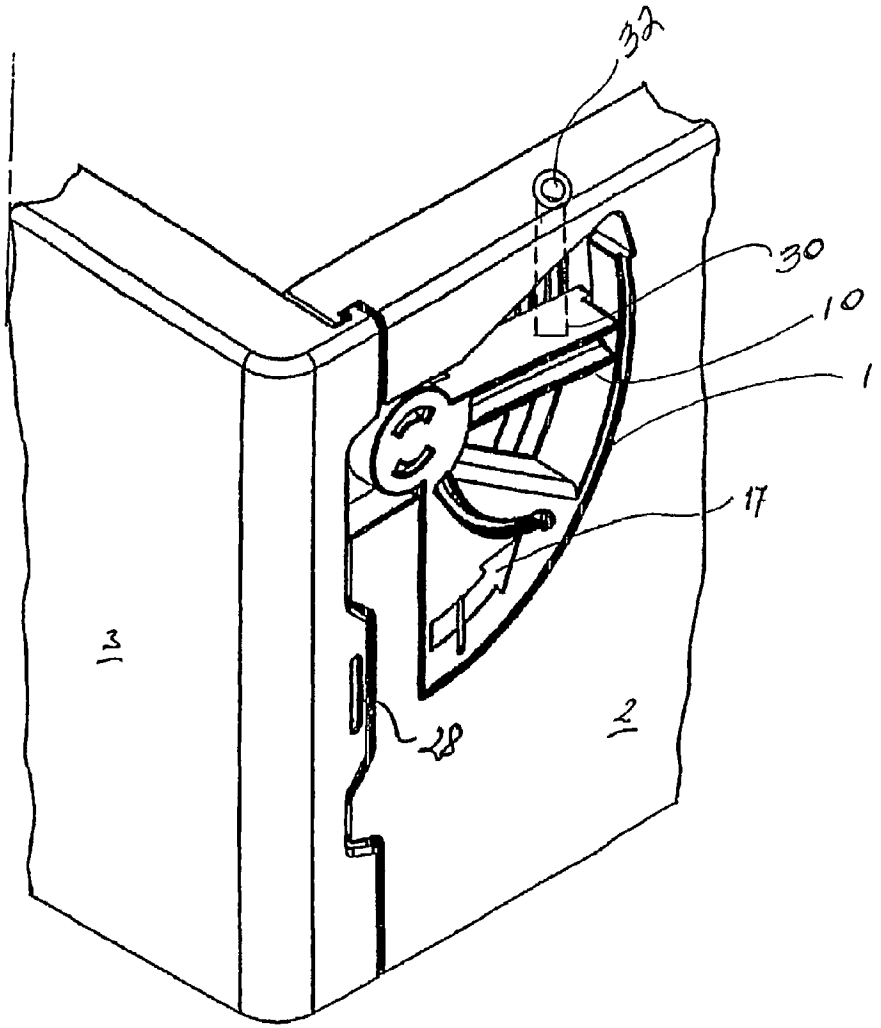
FIG. 1 shows a partial perspective view of the corner area of a collapsible container, and depicts the pivoting lock according to the invention.

In the embodiment illustrated in the drawings, the pivoting lock member is designated generally by the reference numeral 1. The pivoting lock member 1 is accommodated in a first collapsible lateral wall 2, which, in the embodiment illustrated, is one of the short lateral walls of a rectangular container made up of four collapsible lateral walls. Although not illustrated in the drawings, the collapsible lateral walls are hinged via suitable hinge joints or molded-on film hinges to the base of the container and can be folded inwards, one above the other. To do this, first the opposing short lateral walls 2 are folded inwards onto the container base, then the two long lateral walls, which are likewise opposite each other and are adjacent to the short lateral walls 2, are folded inwards, on top of the folded-down short lateral walls 2, onto the base. The second lateral walls, also referred to here as long lateral walls, are denoted by the reference numeral 3.

To accommodate the pivoting lock member 1, the first collapsible lateral wall 2 is provided with a corresponding complementary recess 4. This is especially apparent from FIG. 4. When inserted into the recess 4, the pivoting lock member 1 is advantageously mounted within the recess 4 such that it is substantially flush with the short lateral wall 2 and does not project beyond the exterior surface thereof. For mounting, the pivoting lock member 1 is configured with a pivot pin 5 that has a latch 6 at its free end. In the embodiment illustrated, two opposing, flare-shaped latches 6 are provided. Via this pivot pin 5, the pivoting lock member 1 can be inserted and locked in a bushing 7 configured within the recess 4 in the first collapsible lateral wall 2. To accomplish the insertion of the pivoting lock member 1 into the complementary recess 4, the pivot pin 5 is provided with a through radial slot 8, so that, when the pivot pin 5 is being inserted into the bushing 7, the pivot pin 5 can be pressed together to some extent. As soon as the latches 6 have been pushed through the bushing 7, the pivot pin 5 expands again on account of the elastic restoring forces. The pivoting lock member 1 is thus releasable by reversing this procedure, but is at the same time firmly and sturdily locked with the first collapsible lateral wall 2 in which it is nevertheless rotatably mounted.

Figure 3:
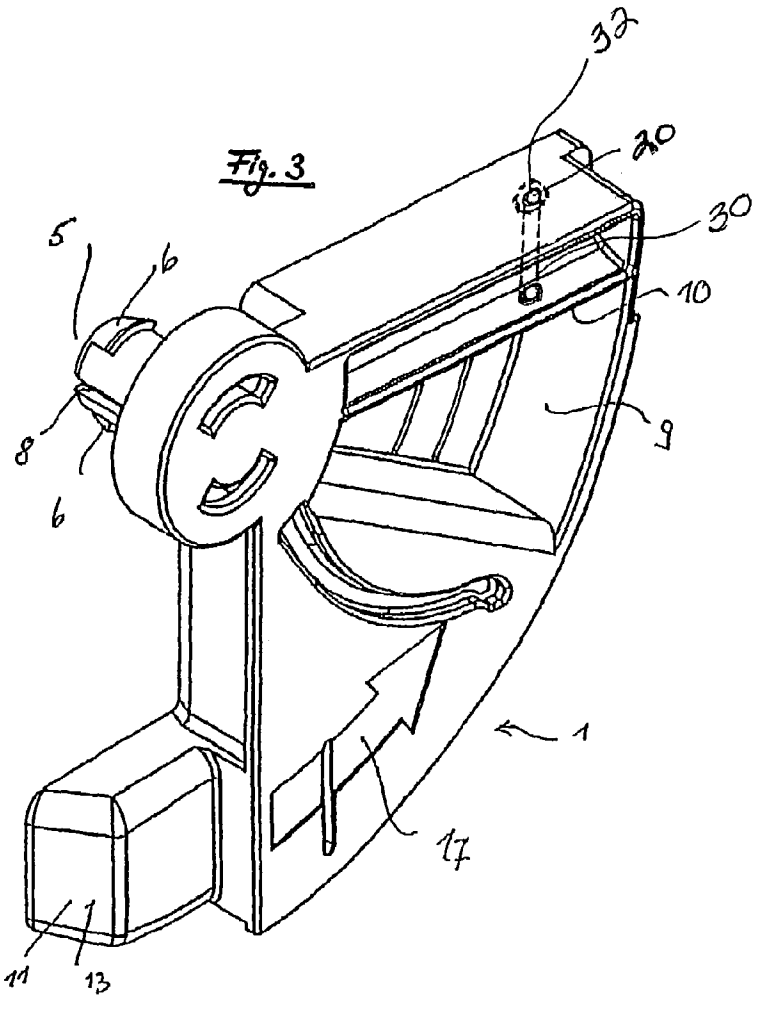
FIG. 3 shows an analogous perspective view of the pivoting lock of FIG. 2, but from the front side or outside of the container, which is visible from the exterior.
Figure 2:
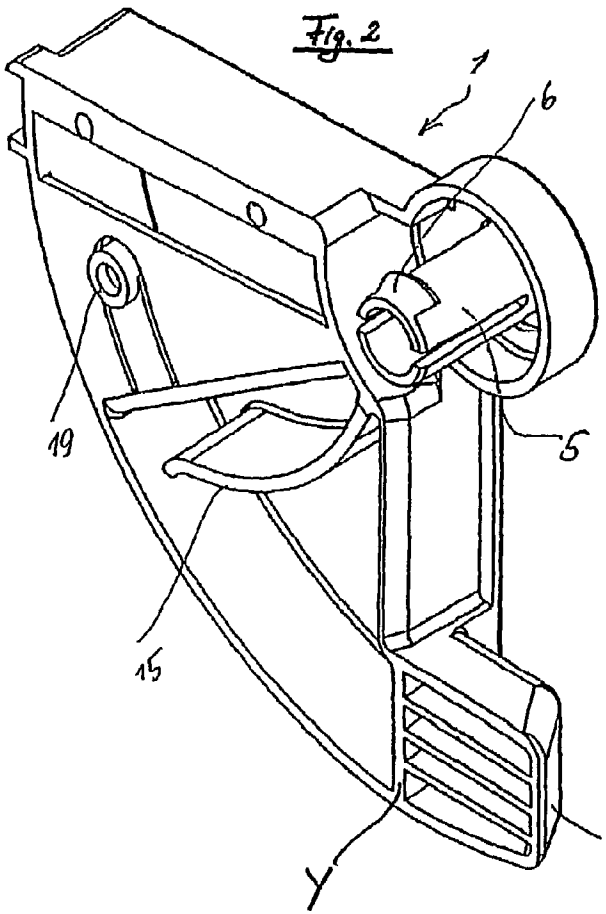
FIG. 2 shows a perspective view of the pivoting lock as viewed from the inside of a container.
Figure 4:
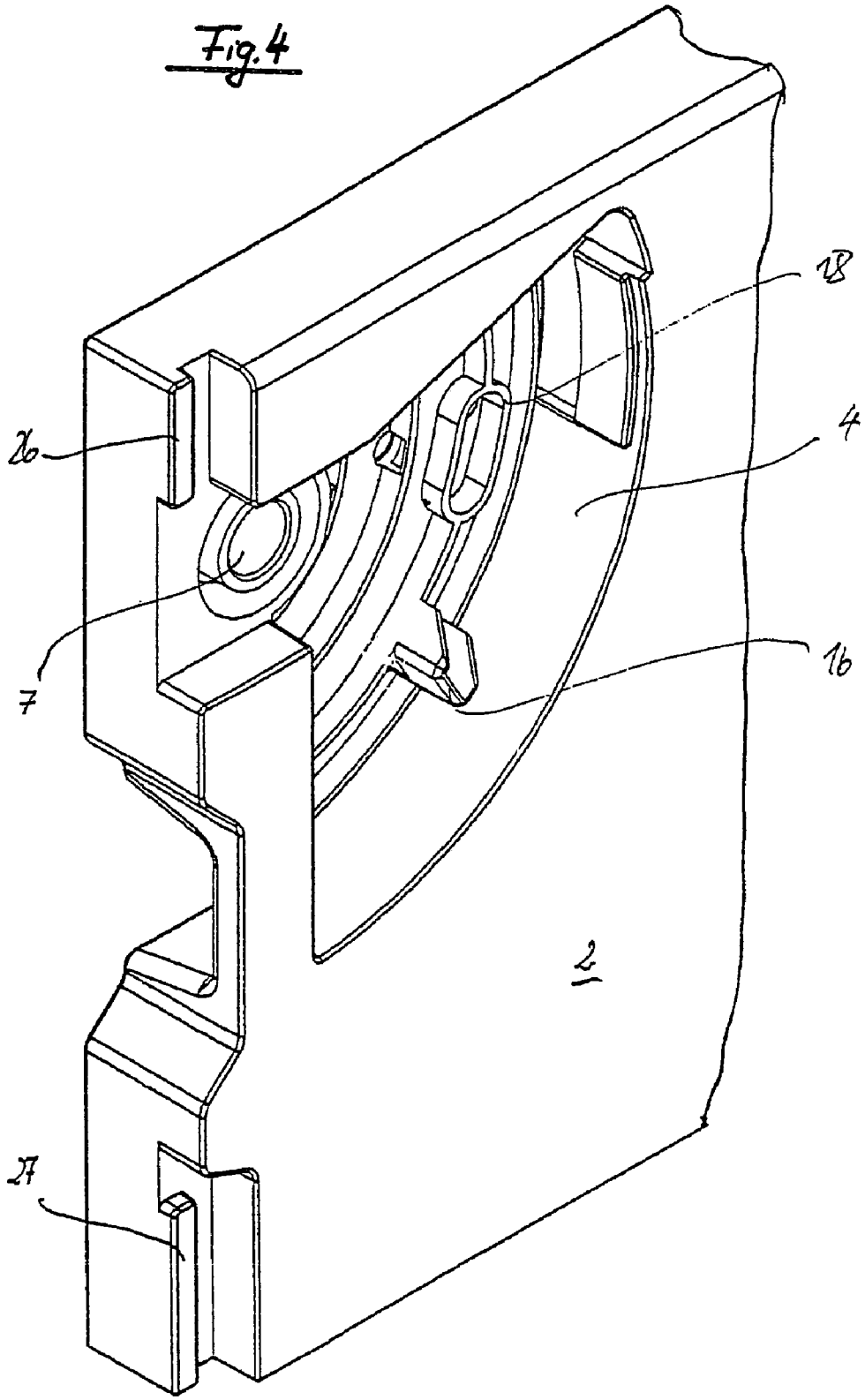
FIG. 4 shows a perspective view of the collapsible lateral wall, in which the pivoting lock of FIGS. 2 and 3 is accommodated.
Figure 5:
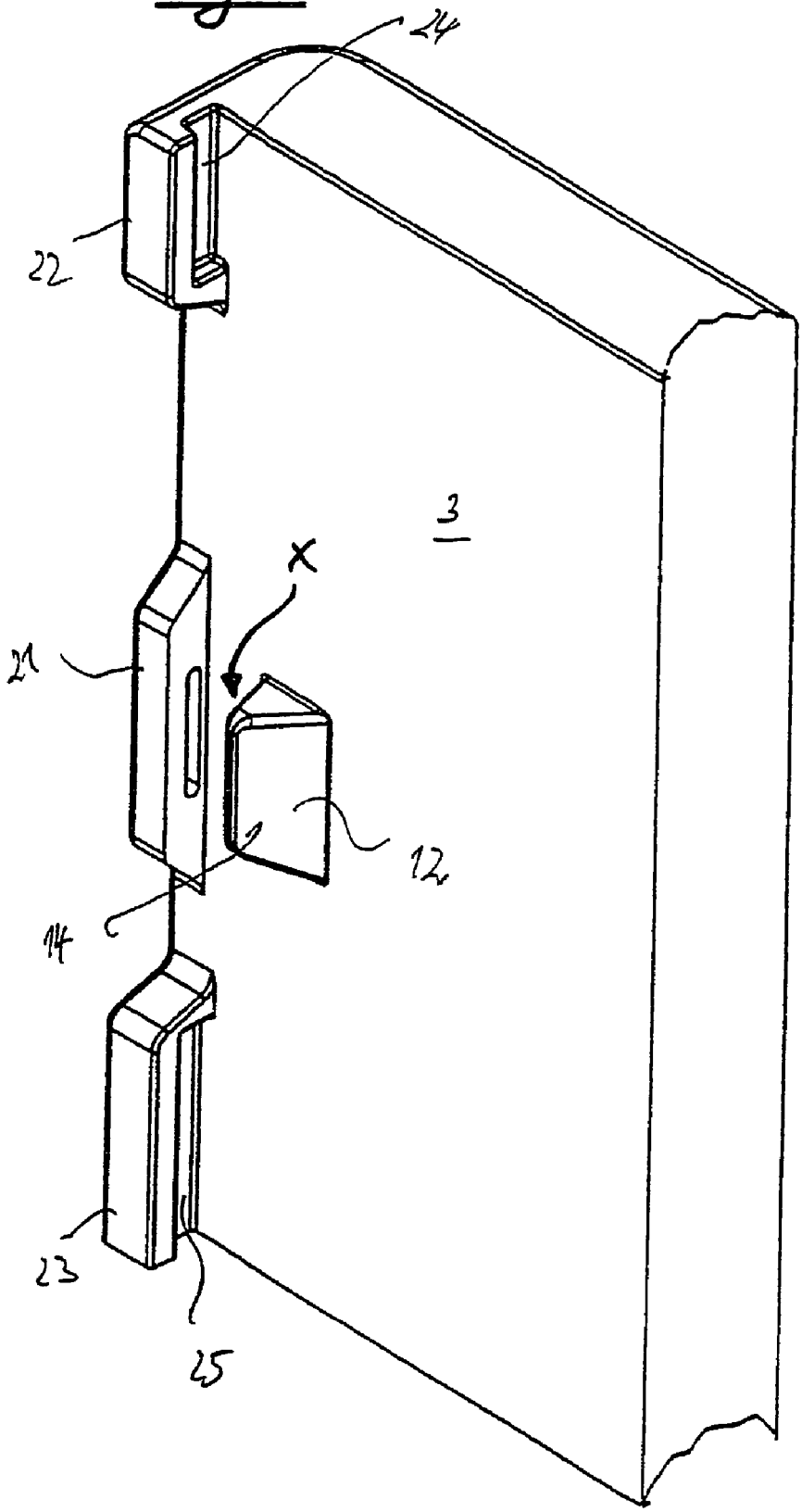
FIG. 5 shows a partial view of an adjacent collapsible lateral wall, on the other side of the corner, which serves as a detent for the lateral wall shown in FIG. 4.

As is apparent, the pivot pin 5/bushing 7 connection described here forms the pivot center for the pivoting lock member 1. As is best seen in FIGS. 2 and 3, the pivoting lock member 1 is configured as a circular-sector-shaped component, the center of which is formed by the centrally disposed pivot pin 5. For purposes of actuation, the pivoting lock member 1 is provided, behind a grip recess 9, with a grip member 10 within a grip ledge. The pivoting lock member 1 is additionally configured with a projecting locking tongue 11, which, in the locked position illustrated in FIG. 1, engages behind a locating lug 12 on the adjacent long lateral wall 3 on the other side of the corner (see FIG. 5). As best seen in FIG. 3 and FIG. 5, both the projecting locking tongue 11 and the inwardly-projecting locating lug 12 on the adjacent long lateral wall 3 have an inclined ascent ramp or ramp surface 13 and 14 respectively, which have matching gradients. Locking ensues on account of two contacting surfaces, namely the surface X on the long lateral wall 3 (FIG. 5) and the surface Y on the pivoting lock member 1 or its projecting locking tongue 11 (FIG. 2). In the locked position illustrated in FIG. 1, the pivoting lock member 1 is pretensioned by a pretensioning spring 15 which, in the embodiment described, is either molded integrally with the pivoting lock member 1 or is otherwise mounted thereon. In this embodiment, the pretensioning spring 15 is configured as an arcuate flexible tongue. This pretensioning spring 15 interacts with a stop 16 on the first or short lateral wall 2. As shown in FIG. 4, this stop 16 is configured as a U-shaped molding which projects into the recess 4. Once again, the stop 16 is expediently molded integrally with the short lateral wall 2. When the pivoting lock member 1 is in the installed position, the free end of the pretensioning spring 15 abuts the stop 16. In the locked position, the two surfaces X and Y abut against each other, and the short and long lateral walls 2, 3 are held in the upright position. By opening the pivoting lock member 1, rotating it counterclockwise as shown in FIG. 1 in the direction of arrow 17 the two surfaces X and Y rotate away from each other to allow the short and long lateral walls 2, 3 to be collapsed. On account of its previously described pretension, the pretensioning spring 15 springs into its rest position. During closing of the short and long lateral walls 2, 3, the rotary movement is generated automatically by the ramp surfaces 14 and 13 by lifting the grip member 10 to move the projecting locking tongue 11 away from the locating lug 12. By way of the rotary movement one defines, so to speak, the position of a "surface", as a result of which a form closure is created. To release the pivoting lock member 1 from the position illustrated in FIG. 1, the grip member 10 is rotated about the pivot pin 5 in the direction of arrow 17; as a result, the pretensioning spring 15 is tensioned against the stop 16. With this opening movement in the direction of arrow 17, the projecting locking tongue 11 is released from its locking position behind the locating lug 12, so that the first short lateral wall 2 can be collapsed inwards onto the base of the container. If one lets go of the grip member 10 here, the pivoting lock member 1 moves in the opposite direction of arrow 17, i.e., in the engaging position of the projecting locking tongue 11, because of the spring tension that has built up. This does not hinder the opening movement, however, because the short lateral wall 2 has already collapsed down towards the base, and the projecting locking tongue 11 has already passed over the locating lug 12.

If the container is to be assembled again, the short and long lateral walls 2, 3 are snapped into locking position. The two short lateral walls 2 are folded upwards; shortly before the upright position, the ramp surfaces 13 of the projecting locking tongues 11 reach the inclined ascent ramp 14 of the respective locating lug 12, causing the pivoting lock member 1 to rotate automatically in the direction of arrow 17. As a result, the projecting locking tongues 11 pass behind the locating lugs 12 and then, on account of the spring tension, engage. This happens because while the projecting locking tongues 11 are ascending the locating lugs 12 via the ramp surfaces 13 and 14, the respective pivoting lock member 1 is swiveled in the direction of arrow 17, thereby pretensioning the pretensioning spring 15 so that, after passing over the locating lugs 12, the pivoting lock members 1, which are preferably mounted at the two upper edges, i.e., at the two upper corner areas of the two first, oppositely disposed short lateral walls 2, can be moved—thanks to the pretensioning spring 15—into the snap-in position behind the locating lugs 12. This configuration ensures a very secure snap connection for the assembled short and long lateral walls 2, 3, these being snapped very easily into locking position by folding the opposing short lateral walls 2 into the upright position. The pivoting lock members 1 need not be actuated to do this.

To limit the movement of the pivoting lock member 1, an arcuate guide element 18, in the form of an oblong hole, is configured within the recess 4, into which guide element 18 a catch member 19 configured on the pivoting lock member 1 or mounted thereon engages. The ends of the oblong guide element 18 thus limit the movement of the pivoting lock member 1.

The pivoting lock member 1 is expediently coupled with a safety catch that prevents the pivoting lock member 1 from opening and thus prevents the first collapsible lateral walls 2 from accidentally collapsing when several containers are in stacked position. The safety catch is expediently configured as an upwardly projecting locking pin 30 located on the upper edge of the pivoting lock member 1, approximately at the position indicated by 20, and in particular being configured integrally with the pivoting lock member 1. When the pivoting lock member 1 moves in the direction of arrow 17, thus releasing the locking mechanism, the locking pin 30 moves upwards out of a corresponding opening 32 at the upper edge of the first collapsible lateral wall 2. However, the movement of the locking pin 30 is blocked by the base of the container stacked above the container in question, so that the pivoting lock member 1 of a stacked container cannot be rotated in the direction of arrow 17 and thus opened.

In order to ensure that the assembled or upright short and long lateral walls 2, 3 are securely locked in position, the second lateral walls 3 are expediently provided with detent members against which the upright first collapsible lateral walls 2 abut. This arrangement prevents the latter from swinging further outwards. To this end, as is seen in FIG. 5, detent ridges 21 are configured immediately behind the locating lug 12. It is useful here if the detent ridge 21 has an opening 28, for example a slot, so that the position of the pivoting lock member 1 is apparent from the exterior. This is easier if the projecting locking tongue 11 has different colors. Additional detent members 22 and 23 with groove-like recesses 24 and 25 are configured at the upper and lower edges of the long lateral wall 3. When the container is assembled, corresponding flexible elements 26 and 27 on the first short lateral wall 2 move into these groove-like recesses 24 and 25, thus ensuring sturdy and reliable snap-in connections between the upright short and long lateral walls 2, 3. This is of substantial importance for customer acceptance of collapsible containers of this kind.

The pivoting lock members 1 are expediently of integral configuration, being made, in particular, of plastic, and engaging as a single component in the complementary recess 4 in the first collapsible lateral wall 2. This facilitates both the production process and use. The advantage of the pivoting lock member 1 consists in that a catch mechanism is provided which is very easy to operate and which permits secure locking and releasing even of large containers, especially large containers measuring 60×80 cm or more. Just a single action and a single operation, namely gripping and rotating the pivoting lock member 1 using the grip member 10, are required to release and simultaneously collapse the short and long lateral walls 2, 3 in the direction of the base. The short and long lateral walls 2, 3 also engage automatically with each other when they are folded upwards to assemble the container, which is of substantial importance for customer acceptance of this catch mechanism and of the collapsible containers. This system simultaneously guarantees a very sturdy container configuration of upright, mutually engaged lateral walls.

What is claimed is:

1. A container comprising:

a container base; and four lateral walls; each said lateral wall of said four lateral walls being hinged to said container base and collapsible inwards onto said container base;

two first opposing lateral walls of said four lateral walls, each first lateral wall of said two first opposing lateral walls having a recess located therein, said recess positioned adjacent an edge of each wall of said two first opposing lateral walls; and a bushing-type opening mounted in said first lateral wall, said bushing-type opening positioned within the confines of said recess;

a resilient pivoting lock member mounted within said recess of said first lateral wall, said resilient pivoting lock member having a pivot pin mounted in said bushing-type opening for mounting said resilient pivoting lock member in said recess of each wall of said two first opposing lateral walls for pivotable movement relative to said first lateral wall; and a projecting tongue latching member; and two second opposing lateral walls of said four lateral walls, each second lateral wall of said two second opposing lateral walls having a locating lug spaced a predetermined distance from an edge of said second opposing lateral wall, said locating lug having opposing ramped surfaces thereon;

such that each said wall of said two first opposing lateral walls are releasably lockable with a respective wall of said two second opposing lateral walls whereby as each wall of said two first opposing lateral walls are moved from a collapsed position adjacent said container base to an upright position, said projecting tongue latching member of said resilient pivoting lock member cooperates with one of said ramped surfaces of said locating lug mounted on each respective wall of said two second opposing lateral walls, to pivot said resilient pivoting lock member in one direction and further cooperate with a second ramp surface of said locating lug to pivot said resilient pivoting lock member in an opposite direction and snap lock into place, in an upright position, behind said locating lug at the edges of each of said two second lateral walls for purposes of locking said four assembled lateral walls.

2. The collapsible container as claimed in claim 1 wherein said resilient pivoting lock member of each said first lateral wall is attached to a respective one of each said second lateral wall via said pivot pin/bushing connection.

3. The collapsible container as claimed in claim 1, wherein in order to accommodate said resilient pivoting lock member, said bushing-type opening is provided in each said first lateral wall, said resilient pivoting lock member configured with said pivot pin member for inserting into said bushing-type opening; and wherein said pivot pin further comprises a plurality of flare-shaped latches mounted at one end; and a pair of radial slits whereby the diameter of said pivot pin can be reduced elastically to allow insertion of said pivot pin into said bushing-type opening and said plurality of latches on said pivot pin grip of each said first lateral wall from behind when said pivot pin is seated, thus locking said pivot pin in position.

4. The collapsible container as claimed in claim 1, wherein said resilient pivoting lock member is configured as a circular-sector-shaped member around said centrally mounted pivot pin.

5. The collapsible container as claimed in claim 1, wherein said resilient pivoting lock member is mounted in said recess of each said first lateral wall in such manner as to be substantially flush therewith.

6. The collapsible container as claimed in claim 1, wherein in the locked position, said resilient pivoting lock member is pretensioned.

7. The collapsible container as claimed in claim 6, wherein said resilient pivoting lock member further comprises a pretensioning spring; and each said first lateral wall further comprises a stop configured in each said first lateral wall.

8. The collapsible container as claimed in claim 7, wherein said pretensioning spring is mounted in spaced relation to said stop such that when said resilient pivoting lock member is in the disengaged position, that is, with an opening movement of said resilient pivoting lock member, said resilient pivoting lock member is pretensioned in the direction of the locking or engaging position.

9. The collapsible container as claimed in claim 1, wherein said projecting tongue latching member in the engaged position, engages behind said locating lug on said second lateral wall.

10. The collapsible container as claimed in claim 7, said projecting tongue latching member further comprises opposing ramped surfaces on a forward edge thereof, and wherein said ramped surfaces on said locating lug have complementary ascent ramps in the form of inclined surfaces, such that when said first lateral wall is folded upwards, said resilient pivoting lock member is rotated by said projecting tongue latching member as they ascend said complementary ramps of said locating lug, and said pretensioning spring is tensioned against said stop while building up restoring forces, whereby said projecting tongue latching member engage behind said locating lug when said first lateral wall is in an upright position.

11. The collapsible container as claimed in claim 7, wherein said pretensioning spring is shaped in the form of an arcuate flexible tongue.

12. The collapsible container as claimed in claim 1, wherein said resilient pivoting lock member further comprises an actuating grip member.

13. The collapsible container as claimed in claim 3, further comprising a catch member mounted on said resilient pivoting lock member; and an arcuate guide element in the form of an oblong hole located in said recess of said first lateral wall, said arcuate guide element limiting the rotary movement of said resilient pivoting lock member in both directions of rotation.

14. The collapsible container as claimed in claim 13, wherein said resilient pivoting lock member further comprises a safety catch mounted in an upper edge of said first lateral wall such that when said resilient pivoting lock member performs an opening movement, said safety catch moves in an upward direction from said upper edge of said first lateral wall in such manner that if a container is stacked on top of the container in question, the exiting movement of said safety catch and hence the opening movement of said resilient pivoting lock member is blocked by said top container.

15. The collapsible container as claimed in claim 14, wherein said safety catch comprises a pin or bolt member mounted integral with said upper edge of said first lateral wall and extending into said recess in a direction towards said resilient pivoting lock member.

16. The collapsible container as claimed in claim 1, further comprising at least one detent member mounted along an edge of said second opposing lateral wall in spaced relation to said locating lug of said second opposing lateral wall said at least one detent adjoining the corners of said first lateral wall and said second opposing lateral wall when said first and second lateral walls are in an upright position.

17. The collapsible container as claimed in claim 16, wherein said at least one detent further comprises a detent member mounted adjacent said locating lug.

18. The collapsible container as claimed in claim 16, wherein said at least one detent comprises additional detent members located at the upper and lower edges of said first lateral wall said additional detent members cooperating with said second lateral wall to connect thereto.

19. The collapsible container as claimed in claim 18, wherein said additional detent members are configured with grooves and said second opposing lateral wall further comprises complementary flexible elements located at the upper and lower edges of said second lateral wall to engage said configured grooves of said additional detent members to form a tongue-and-groove connection when said four lateral walls are in an upright position.

20. The collapsible container as claimed in claim 1, wherein said resilient pivoting lock members are each mounted in an upper corner area of the respective said first lateral wall of said collapsible container.

21. The collapsible container as claimed in claim 17, wherein the distance between said at least one detent member and said locating lug is essentially corresponding to the width of said projecting tongue latching member for wobble-free arrangement.

* * * * *